US007891519B2

(12) United States Patent
Matsukawa et al.

(10) Patent No.: US 7,891,519 B2
(45) Date of Patent: Feb. 22, 2011

(54) EASY OPEN CAN LID

(75) Inventors: Yoshihiko Matsukawa, Sagamihara (JP); Wataru Hasegawa, Sagamihara (JP); Masahiro Shiotani, Sagamihara (JP); Jun Kaimori, Sagamihara (JP)

(73) Assignee: Daiwa Can Company, Tokyo (JP)

( * ) Notice: Subject to any disclaimer, the term of this patent is extended or adjusted under 35 U.S.C. 154(b) by 874 days.

(21) Appl. No.: 11/444,463

(22) Filed: Jun. 1, 2006

(65) Prior Publication Data

US 2007/0131693 A1 Jun. 14, 2007

(30) Foreign Application Priority Data

Dec. 7, 2005 (JP) ..... 2005-353951

(51) Int. Cl.
*B65D 17/34* (2006.01)

(52) U.S. Cl. ..... 220/272; 220/269; 220/270; 220/271; 220/273

(58) Field of Classification Search ..... 220/906, 220/269, 270, 271, 272, 273; 413/14
See application file for complete search history.

(56) References Cited

U.S. PATENT DOCUMENTS

| | | | | |
|---|---|---|---|---|
| 1,955,431 | A * | 4/1934 | Lymburner | 220/269 |
| 2,146,226 | A * | 2/1939 | Punte | 229/123.3 |
| 3,151,765 | A * | 10/1964 | Griese, Jr. | 220/269 |
| 3,690,506 | A * | 9/1972 | Kennedy et al. | 220/257.2 |
| 3,765,561 | A * | 10/1973 | Hekal et al. | 220/270 |
| 3,860,143 | A * | 1/1975 | Strobe et al. | 220/269 |
| 4,386,713 | A * | 6/1983 | Baumeyer et al. | 220/269 |
| 4,913,305 | A * | 4/1990 | Hanafusa et al. | 220/269 |
| 4,982,862 | A * | 1/1991 | La Barge | 220/278 |
| 6,202,881 | B1 * | 3/2001 | Chiang | 220/269 |

FOREIGN PATENT DOCUMENTS

| | | |
|---|---|---|
| JP | 60-177022 | 11/1985 |
| JP | 62-72922 | 5/1987 |

(Continued)

OTHER PUBLICATIONS

U.S. Appl. No. 11/908,353, filed Sep. 11, 2007, Hasegawa, et al.

*Primary Examiner*—Anthony Stashick
*Assistant Examiner*—Kareen Rush
(74) *Attorney, Agent, or Firm*—Oblon, Spivak, McClelland, Maier & Neustadt, L.L.P.

(57) ABSTRACT

An easy open can lid having: a panel portion, which is formed of an approximate disc shape, and in which a flange portion for fixing a can trunk is formed integrally on an outer circumference; a score line, which is formed near the periphery of the panel portion along the outer circumference of the panel portion; an opening piece, which is defined by the score line; and an opening tab, which is fixed near the periphery of the opening piece. This easy open can lid of the invention is characterized in that the score line is formed of an arcuate along periphery of the panel portion and both ends thereof are separated, and comprises a connecting portion connecting the opening piece with the panel portion, which is formed between the both ends of the score line, and a strength incrementing portion, in which a rupture strength thereof increases gradually toward the end portion of the score line.

6 Claims, 10 Drawing Sheets

FOREIGN PATENT DOCUMENTS

| | | |
|---|---|---|
| JP | 2-180148 | 7/1990 |
| JP | 6-47128 | 6/1994 |
| JP | 2000-190963 | 7/2000 |
| JP | 2004-155480 | 6/2004 |
| JP | 2004-161360 | 6/2004 |

* cited by examiner

EASY OPEN CAN LID

BACKGROUND OF THE INVENTION

1. Field of the Invention

The present invention relates to a can lid opened by rupturing a score line, and more particularly, to a can lid (i.e., an easy open end) opened by lifting a tab mounted on an opening piece to propagate the rupture along the score line.

The disclosure of Japanese Patent Applications No. 2005-353951 filed on Dec. 7, 2005, and No. 2003-375160 filed on Nov. 5, 2005, including specification, drawings and claims are incorporated herein by reference in its entirety.

2. Discussion of the Related Art

The can lid of this kind is used in a beverage can or a can containing solid materials such as fruits or meat. As a can lid for the former can containing liquid such as a beverage, a partial open type can lid, in which a panel portion of the can lid opens partially to form an opening, is known in the art. Especially, a stay on tab type easy open can lid is used generally in the conventional art. According to the stay on tab easy open can lid, a can is opened without detaching a tab and an opening piece from the can (or a can lid). On the other hand, the latter can containing solid materials have to be opened widely to eject the solid contents easily. For this purpose, a can lid called a full-open type can lid has been developed. A panel portion of this kind of full-open type can lid is opened widely by rupturing a score line formed around the panel portion of the can lid.

An example of the full-open type can lid is disclosed in Japanese Patent Laid-Open No. 2004-161360. In the can lid disclosed by this publication, the score line is formed annularly. Therefore, when a tab mounted on an opening piece is lifted, the opening piece defined by the score line is ruptured along the score line and the opening piece is detached from the can lid eventually. As a result, an opening can be formed widely. On the other hand, if the can is opened at once, or if the opening piece is detached from the panel portion abruptly, the contents may be scattered out of the can due to an opening shock. For this reason, according to the invention taught by Japanese Patent Laid-Open No. 2004-161360, a residual thickness of the score line in a portion opposite to a portion where the tab is mounted is made thicker to gradually increase rupture strength. Therefore, the propagation of the rupture of the score line is halted just before the termination of opening operation.

Meanwhile, Japanese Patent Laid-Open No. 2004-155480 discloses an example of a can lid whose opening dimension is limited to about half area of a panel portion. According to the can lid suggested by this publication, a score line is formed half round of the panel portion, and a fold guide which is not to be ruptured is formed linearly connecting both ends of the score line. According to the can lid of this kind, the opening piece is folded at the fold guide so that an opening dimension can be substantially widen without the opening piece intervening, even if the opening piece opens only within a half area of the panel portion. Moreover, it is possible to close the lid temporarily by returning the opening piece.

The aforementioned full-open type can lid is capable of opening the panel portion widely so that the contents can be ejected comparatively easily even if the solid materials are contained therein. However, if the opening piece of the full-open type easy open can lid is completely detached from the can lid and thrown away, this becomes a problem in view of resource recovery and environmental conservation. In order to cope with this kind of problem, the annular score line is formed as an incomplete circle, specifically, both ends of the score line are separated at a certain distance to be faced to each other. One example is disclosed in Japanese Utility Model Laid-Open No. H6-47128. According to the full-open type can lid of this kind, the opening piece is kept connected with the can lid at a portion between the both ends of the score line, i.e., at an unscored portion. The unscored portions are formed in a portion of an outer circumference of the panel portion, therefore, the panel portion can be opened almost entirely.

As mentioned above, if the opening piece of the full-open type can lid is completely detached from the can lid, the opening piece is thrown away and this causes a problem in view of resource recovery and environmental conservation. However, the opening piece may be detached due to an extension of a rupture to the unscored portion, even if the unscored portion is formed to keep the opening piece connected with the can lid. Specifically, when the tab is lifted, a portion of the score line is ruptured initially, and then, the rupture is propagated as the tab is pulled backward. Since the rupture along the score line is propagated at an accelerating pace, the rupture may extend to the unscored portion. As a result of this, the unscored portion is ruptured so that the can lid is opened wider than expected or the opening piece is detached completely from the can lid.

The above-mentioned can lids disclosed by individual patent documents are capable of widening the opening dimension, however, a sharp edge is created almost all around the opening portion as a result of the rupture of the score line. The sharp edge is also created almost all around the outer circumference of the opening piece. In order to avoid injury by the sharp edge, an overlapping portion is formed all along the score line.

The overlapping portion, which is also called as a safety portion, is formed by folding a metal sheet forming the panel portion at an outer circumference of a portion to be the opening piece, and at an inner circumference of the opening created as a result of a rupture of the score line. In the opening piece side, the metal sheet is folded into multiple layers to form the overlapping portion on an upper face of the opening piece, and in the opening side, the metal sheet is folded into multiple layers to form the overlapping portion on a lower face of the panel portion (i.e., in an inner side of the can container). The score line is formed on an intermediate portion between those overlapping portions of inner and outer circumferential sides.

In any of aforementioned types of the can lids, it is preferable to rupture the score line gradually when open the can lid. For this purpose, it is preferable to open the lid while folding or bending the opening piece. However, section modulus of aforementioned overlapping portion is high so that stiffness thereof is enhanced. This makes the opening piece hard to be folded or bent. As a result of this, the score line is ruptured abruptly and the contents may be scattered out of the can.

Further, in case an inner pressure of the can container rises, the panel portion or the opening piece is inflated into a domed shape, and such deformation of the panel portion or the opening piece may not be restored even if the inner pressure is lowered as a result of an opening operation. This kind of deformation may interrupt the folding or bending of the opening piece, therefore, a bead portion may be formed on the opening piece so as to avoid such deformation. For example, the bead portion is formed by recessing a portion of the opening piece linearly, however, this increases the stiffness of the opening piece itself. The high stiffness of the opening piece and the overlapping portion makes the opening piece hard to be folded or bent when open the can lid. As a result of this, the score line is ruptured abruptly and the contents may be scattered out of the can.

SUMMARY OF THE INVENTION

An object of the present invention is to prevent a rupture of an unscored portion by halting a propagation of the rupture of a score line resulting from an operation of a tab certainly at an end portion of the score line.

An another object of the invention is to prevent an abrupt open of a can lid, in which an overlapping portion is formed around an opening piece, by gradually undermining the propagation of the rupture along the score line.

According to the present invention, there is provided an easy open can lid having: a panel portion, which is formed of an approximate disc shape, and in which a flange portion for fixing a can trunk is formed integrally on an outer circumference; a score line, which is formed near the periphery of the panel portion along the outer circumference of the panel portion; an opening piece, which is defined by the score line; and an opening tab, which is fixed near the periphery of the opening piece. This easy open can lid of the invention is characterized in that the score line is formed of an arcuate along periphery of the panel portion and both ends thereof are separated, and comprises a connecting portion connecting the opening piece with the periphery of the panel portion, which is formed between the both ends of the score line, and a strength incrementing portion, in which a rupture strength thereof increases gradually toward the end portion of the score line. The connecting portion is an unscored portion which is not to be ruptured, and a linear fold guide is formed thereon by applying pressure for example. Therefore, the connecting portion is not ruptured but folded easily.

Therefore, stronger force is required to rupture the score line near the end portion of the score line, so that the propagation of the rupture is halted near the end portion of the score line. For this reason, the connecting portion can be prevented from being ruptured and the opening piece is thereby kept connected with the can lid.

The strength incrementing portion of the invention may be formed by thickening a residual thickness of the score line, or by widening a width of the score line.

According to the can lid of the invention, the opening piece ruptured along the score line is folded at the connecting portion. For this purpose, according to the invention, a fold guide is provided in the connecting portion. The fold guide comprises a bead portion for increasing bending stiffness regionally. Alternatively, the fold guide may comprise a depressed line for weakening the strength along the line connecting both ends of the score line.

Moreover, the can lid of the invention comprises an overlapping portion for covering an edge created as a result of rupturing the score line. The overlapping portion is formed by folding a metal sheet forming the panel portion, and it can be formed all around the outer circumference of the opening piece, and all around the inner circumference of the opening created by rupturing the score line.

The overlapping portion is a portion where a metal sheet is folded and overlapped so that the bending stiffness thereof is high. According to the invention, a weakened portion can be formed for the purpose of facilitating a folding of the opening piece, by crushing a portion of the overlapping portion.

In case the can lid receives a pressure from inside, a linear bead portion can be formed in the opening piece so as to suppress expansion of the opening piece. In this case, the weakened portion is formed as an extension of the linear bead portion. This allows the opening piece to be folded easily.

Furthermore, according to the present invention, a portion to be the opening piece is formed no less than 50 percent and no more than 99 percent of the panel portion.

In addition, according to the present invention, the constitution in which the weakened portion is formed in a portion of the overlapping portion can also be applied to a can lid in which a score line is formed annularly.

The above and further objects and novel features of this invention will more fully appear from the following detailed description when the same is read with reference to the accompanying drawings. It is to be expressly understood, however, that the drawings are for purpose of illustration only and are not intended as a definition of the limits of the invention.

DETAILED DESCRIPTION OF THE PREFERRED EMBODIMENT

Figure 1A:
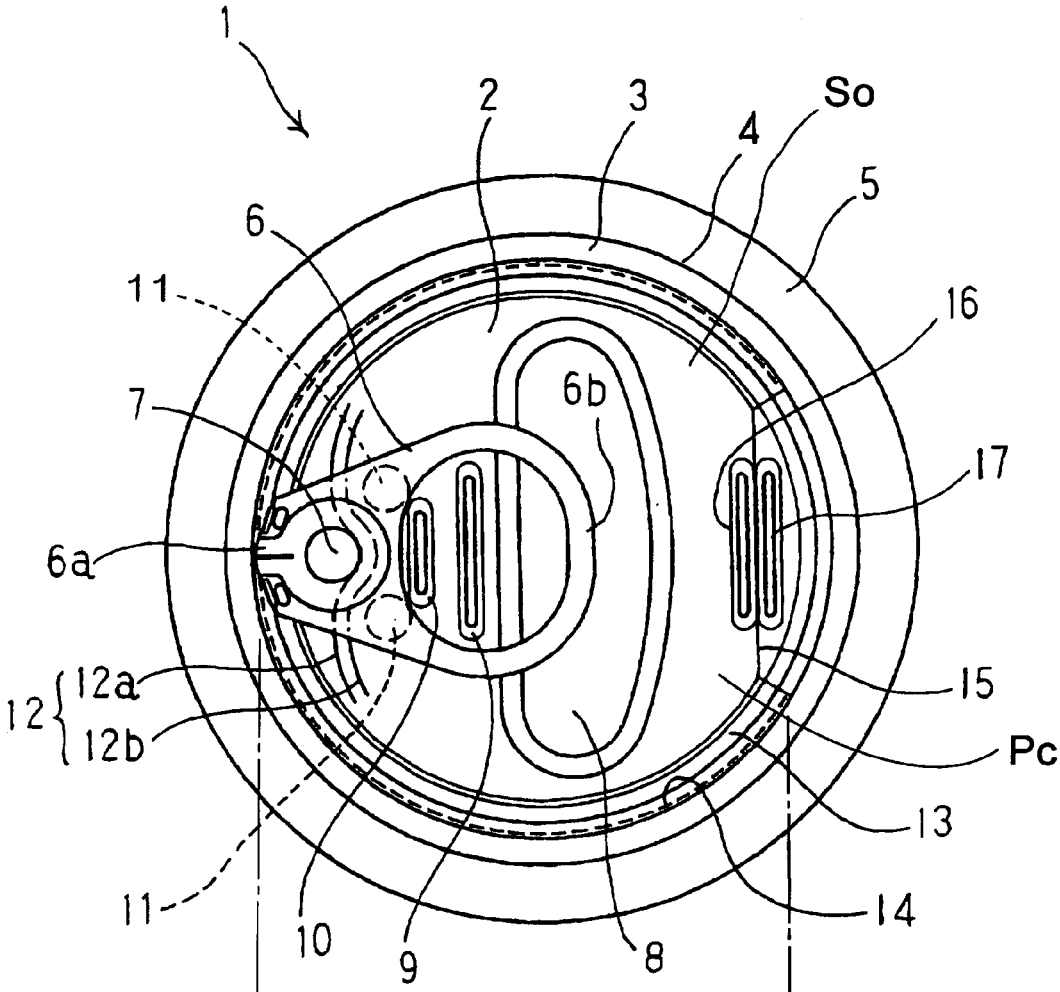
FIG. 1A is a top view showing a can lid before fixed with a can trunk by a seaming method, as one example of the easy open can lid of the invention.
Figure 2:
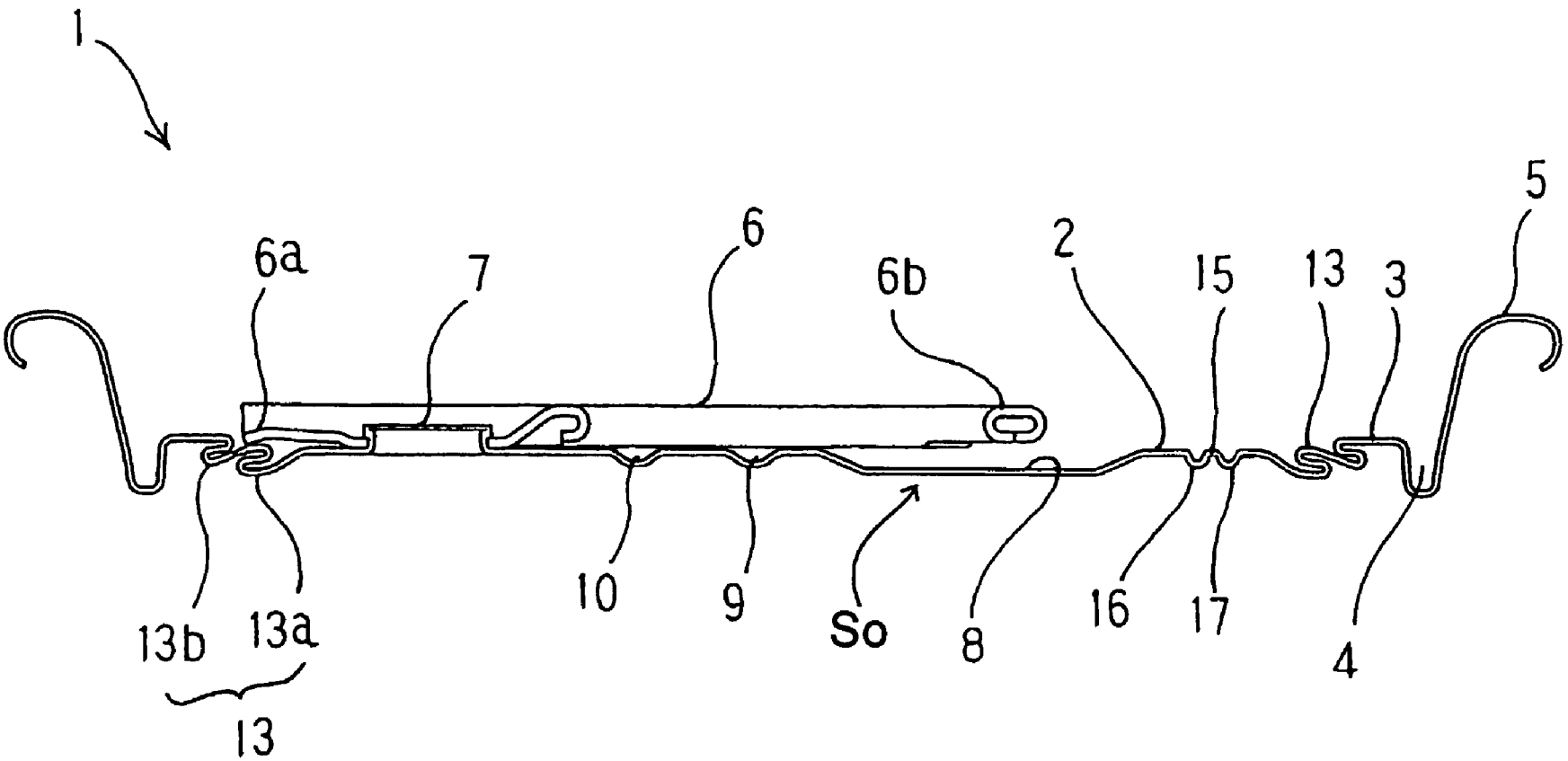
FIG. 2 is a sectional view of the can lid illustrated in FIG. 1A.

An easy open can lid 1 according to the present invention is formed by pressing an aluminum alloy sheet. As illustrated in FIGS. 1A and 2, a substantially disc shaped panel portion 2, an annular rim 3 as an outer circumference of the panel portion 2, a counter sink 4 positioned outer side of the annular rim 3, and a flange portion 5 are integrally formed in a main body. A separately formed tab 6 for opening operation is fixed by a rivet portion 7 formed near the periphery of the panel portion 2. Although not shown, an organic macromolecule sealing agent is applied to a backside of the flange portion 5 which is to be fixed with a can trunk by a seaming method.

A recessed portion 8 is formed in a large area of the panel portion 2. The recessed portion 8 enhances stiffness of the panel portion 2 and facilitates to nip the tab 6. There are also formed two lines of recessed portions 9 and 10 in the panel portion 2. Those recessed portion 9 and 10 functioning as a bead portion enhance the stiffness of the panel portion 2. Under the tab 6, there are formed a pair of hemisphere shaped convex portions 11 and 11 contacting a lower face of the tab 6. A bend score 12 is formed in the vicinity of the rivet portion 7 on the opposite side of a leading end portion of the tab 6*a* across the rivet portion 7. This bend score 12 is provided for the purpose of equalizing the inner pressure of the can and the atmosphere pressure by initiating a rupture to unseal the can just before rupturing the score line formed around the panel portion, and facilitating to fold a portion of the panel portion 2 near and under the leading end portion of the tab 6*a* downwardly when the tab 6 is lifted. The bend score 12 comprises a rupturable main score line 12*a* and a sub score line 12*b* which is not ruptured.

Figure 3:
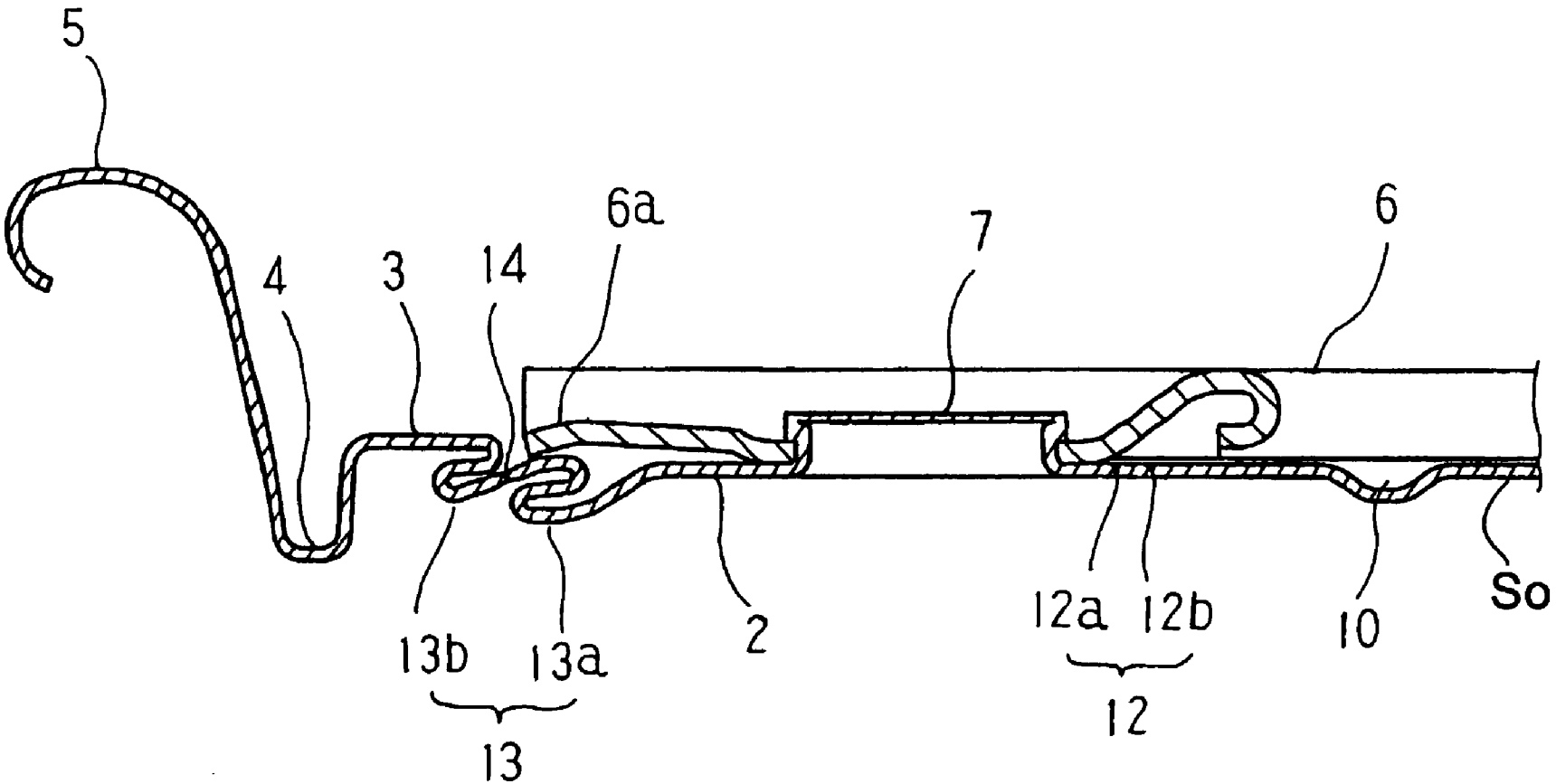
FIG. 3 is an enlarged partial sectional view showing a portion of the can lid illustrated in FIG. 2.

An overlapping portion 13, in which the metal sheet is folded into multiple layers, is formed between an outer edge of the panel portion 2 and an inner edge of the annular rim 3 surrounding outside of the outer edge of the panel portion 2. The overlapping portion 13, which is also called as a safety portion, is formed between the panel portion 2 and the annular rim 3 around an entire circumference, for the purpose of cloaking a sharp edge created as a result of rupture of the metal sheet. As illustrated in FIG. 3, the overlapping portion 13 is formed on both the panel portion 2 and the annular rim 3 sides. Specifically, an overlapping portion 13*a* whose section is "S-shape" is formed on an upper face of the panel portion 2 at an outer end by folding the metal sheet into three layers, and an overlapping portion 13*b* whose section is "S-shape" is formed on a lower face of the annular rim 3 at an inner end by folding the metal sheet into three layers. Both end portions of folded portions of overlapping portions 13*a* and 13*b* connect with each other.

As illustrated in FIG. 1A, a rupturable score line 14 as a depressed line is formed along the outer edge of the panel portion 2 on the boundary between the outer edge of the panel portion 2 and the inner edge of the annular rim 3 (more specifically, on a continuous portion of said overlapping portions 13*a* and 13*b*). In the accompanying figures, the score line 14 is drawn as a broken line so as to be identified readily, but actually, the score line 14 is a continuous depressed line. The figure of the score line 14 is not a complete circle, i.e., the score line 14 is curved to form an arcuate in which both end portions are opposed to each other keeping a certain distance. A portion between the both ends of the score line 14 is an unscored portion where the depressed line is not drawn. This is a connecting portion Pc of the invention.

Between both end portions of the score line 14, a fold guide 15 which is not ruptured is formed linearly. As described above, the score line 14 is a rupturable score line. However, on the other hand, the fold guide 15 is a linear unscored portion which is not ruptured by a normal tension. The fold guide 15 may be a depressed line which cannot be ruptured. Alternatively, the fold guide 15 may be formed by merely applying pressure linearly. In the vicinity of the fold guide 15, there are formed rib-shaped bead portions 16 and 17 for increasing the stiffness of both sides of the fold guide 15 so as to ensure a folding of the fold guide 15. The bead portions 16 and 17 may be any of a convex and a concave bead. Preferably, the length of the bead portions 16 and 17 are within 10 mm to 20 mm, and the height and its curvature radius are within 0.2 mm to 1.0 mm.

A region enclosed by the score line 14 and the fold guide 15 is an opening piece So. In the opening piece So, a tab 6 is fixed onto the panel portion 2 (or the opening piece So) by the rivet portion 7, on the opposite side of the connecting portion Pc and in the vicinity of the score line 14. The leading end portion 6*a* of the tab 6 fixed by the rivet portion 7 is adjacent to a portion of the score line 14. The aforementioned bend score 12 extending to both side directions of the rivet portion 7 is formed on the opposite side of the leading end portion of the tab 6*a* across the rivet portion 7.

Figure 1B:
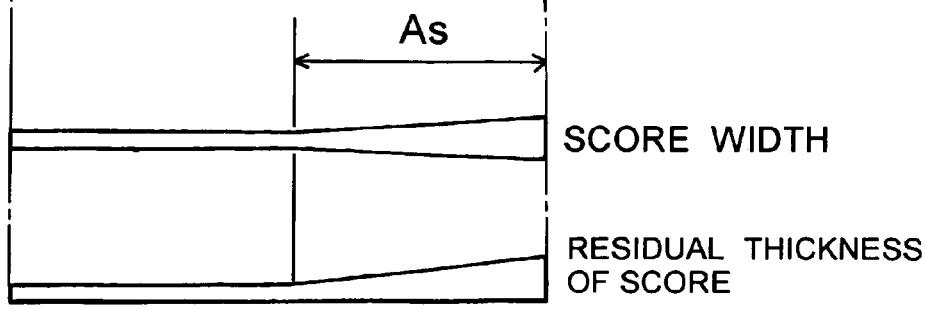
FIG. 1B is an explanatory diagram schematically showing a width and a residual thickness of the score portion along the outer circumference of the panel portion, from an initial ruptured point to the end portion.

Meanwhile, the aforementioned score line 14 is a groove whose section is substantially "V-shape" so that the thickness thereof is thin. That is, the score line 14 induces a rupture of the panel portion 2. The load to rupture along the score line 14 is not constant. This means that the resistance against the rupture is higher at the end portion side of the score line 14. Specifically, a strength incrementing portion As is formed in the score line 14. In the strength incrementing portion As, at least one of the depth and the width of the score line 14 is varied in comparison with those of remaining portion. As can be seen from FIG. 1B, the depth and the width of the score line 14 are constant to the halfway point between the point in the vicinity of the tab leading end portion 6*a* and the end portion. On the other hand, in the end portion side of the score line 14, the residual thickness and the width of the score line 14 increase gradually toward the end portion. Here, the residual thickness of the score line is the thickness of the metal sheet underneath the score line, and the residual thickness is thickened by shallowing the depth of the score line 14. On the other hand, the width means an opening width of the V-shaped groove. In the strength incrementing portion As, the residual thickness and the width of the score line 14 are thus increased gradually, so that the rupture strength of the score line 14 (i.e., an resistance of the score line 14 against rupture) increases gradually.

Specifically, a difference in the residual thickness of the score line 14 is 50 μm to 70 μm (preferably 55 μm to 65 μm), between the thickness in the region from the vicinity of the tab leading end portion 6*a* to the halfway point, and the thickness in the end portion side. That is, the residual thickness of the score line 14 increases gradually in the region from the halfway point to the end portion. In the region where the residual thickness of the score portion 14 is constant, the width thereof is also constant at approximately 25 μm. On the other hand, in the strength incrementing portion As, the width of the score portion 14 widens gradually to the range from 30 μm to 50 μm (preferably from 35 μm to 45 μm).

The can lid 1 seals the can body by seaming the flange portion 5 to the upper end opening portion of the can body (i.e., a main body of the can) in which the content is filled.

Figure 4A:
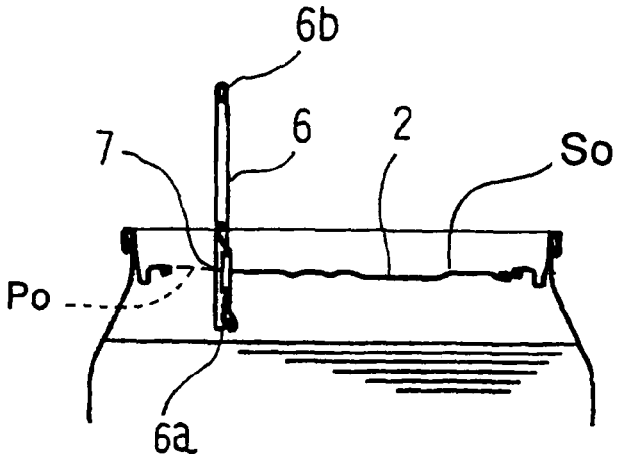
FIG. 4A is an explanatory sectional view showing an initial phase of opening the can lid.

When open the can lid 1, the tab 6 is lifted first of all by hooking a finger on a gripping portion (i.e., a rear end portion) 6*b*. Consequently, the main score line 12*a* of the bend score 12 is ruptured, and the panel portion 2, i.e., the opening piece So is bent easily in the vicinity of both sides of the bend score portion 12. Then, as illustrated in FIG. 4A, the rivet portion 7 turns almost 90 degrees and erects using the portions in the vicinity thereof (i.e., both side portions of the bend score portion 12) as a fulcrum, and the leading end portion 6*a* is depressed downwardly. As a result of this, the tab 6 is erected while causing an initial rupture of the score line 14 underneath the leading end portion 6*a* of the tab 6. In other words, a furthermost portion of the score line 14 from the both end portions (or from the aforementioned connecting portion Pc) is ruptured initially by a principle of leverage using the gripping portion 6*b* of the tab 6 as a main emphasis, and the leading end portion 6*a* of the tab 6 as a point of action.

Figure 4B:
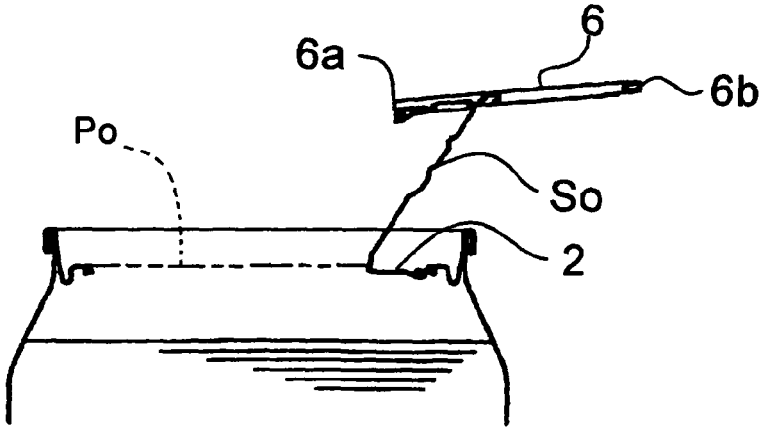
FIG. 4B is an explanatory sectional view showing an intermediate phase of opening the can lid.
Figure 4C:
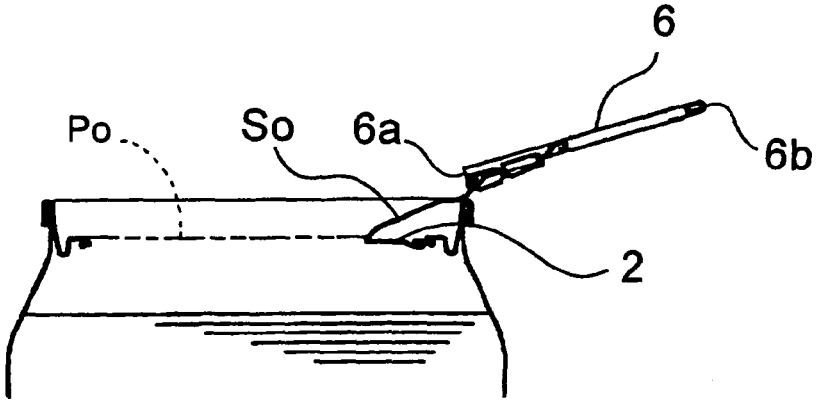
FIG. 4C is an explanatory sectional view showing a final phase of opening the can lid.

Then, the score line 14 is ruptured to its both ends thereof, i.e., to the portion connecting to the fold guide 15 by lifting the tab 6, and the opening piece So lifted together with the tab 6 is folded at the fold guide 15. Under such circumstances, the area enclosed by the score line 14 and the fold guide 15 is the opening piece So, and the most part of the panel portion 2 is opened as illustrated in FIG. 4B. Then, as illustrated in FIG. 4C, the opening piece So is folded downward and posterior to an opening Po by pressing the tab 6 downwardly. As a result, an upside of the can container is opened widely and the opening operation of the can lid is completed.

As thus far described, according to the can lid 1 of the present invention, the most part of the panel portion 2 can be opened widely by rupturing the score line 14 by the operation the tab 6, and by folding the opening piece So backward at the fold guide 15. Therefore, the contents can be ejected easily even if solid materials are contained, without leaving the solid materials in the can container.

Moreover, since the can lid 1 is provided with the strength incrementing portion As in which the resistance against rupture is increased gradually, the score line 14 gets gradually harder to be ruptured as getting closer to its end portion even if it is ruptured continuously. Specifically, the momentum of the rupture propagating along the score line 14 is undermined at the strength incrementing portion As. Therefore, the rupture of the score line 14 is certainly halted at its end portion. For this reason, the unscored portion such as the aforementioned connecting portion Pc can be certainly prevented from being ruptured subsequent to the score portion 14.

Additionally, the can lid 1 is provided with the fold guide 15 connecting the both end portions of the score portion 14, and the bead portions 16 and 17 are formed on both sides of the fold guide 15 to enhance the stiffness. Therefore, the opening piece So can be certainly bent along the fold guide 15, and folded backward easily. Since the opening piece So can be folded certainly at a certain position, i.e., at the line connecting both ends of the score portion 14, the propagation of the rupture along the score line 14 can be halted certainly at the end portions of the score line 14.

Further, according to the can lid 1 of the present invention, since the opening piece So can be folded downwardly posterior to the opening Po, the opening piece will not interrupt a consumer by touching his/her nose and mouth when the consumer drinks the content in the can directly from the opening Po. Also, since the overlapping portion 13*a* whose section is S-shape is formed on the edge of the opening piece So (i.e., on the edge created as a result of rupturing the score line 14), the folded portion of outer side of the overlapping portion 13*a* protect the consumer's nose, mouth, and hands from getting injured by the sharp edge created as a result of rupturing the score line 14, even if the consumer touches the opening piece So.

Here will be explained a procedure to close the opening Po of the can lid 1 temporally by the opening piece So in case the content is left in the can. First of all, under the state where the can is completely opened as illustrated in FIG. 4*c*, the tab 6 is lifted almost horizontally by fingers as illustrated in FIG. 4B. Then, the tab 6 is pushed ahead to go down while keeping its horizontal posture. The opening piece So, which has been folded downwardly posterior to the opening Po, is thereby stretched forward to cover the opening Po from above almost at the same level as a remaining portion of the panel portion 2. As a result, the opening Po is covered completely by the opening piece So.

As mentioned above, the overlapping portion 13*a* is formed on the outer edge of the opening piece So so that the bending stiffness of the opening piece So is enhanced. Therefore, a deformation such as warpage of the opening piece So can be prevented when the can is closed by returning the opening piece So as explained above. This allows the opening piece So to be returned easily to the temporal closing position from the opening position illustrated in FIG. 4C.

Here, the present invention should not be limited to the embodiment thus far described. For example, the forming area of the opening piece So in the panel portion 2 may be no less than 50 percent and no more than 99 percent of the panel portion 2, and the length of the score line and the unscored portion may be set arbitrarily depending on the opening dimension.

Also, the structure of the strength incrementing portion for gradually increasing the rupture strength of the score line should not be limited to the structure in which both the residual thickness and the width of the score portion are increased gradually. According to the invention, the strength incrementing portion may be formed by gradually increasing any one of the residual thickness and the width of the score line. Moreover, starting points and a range of the strength incrementing portion should not be limited within a half range of the score line in the unscored portion side defined from the halfway points between the fixing portion of the tab and the unscored portion (or connecting portion). The starting points and the range of the strength incrementing portion may be set arbitrarily depending on the dimension of the opening of the can lid or the like.

Furthermore, the fold guide formed between the end portions of the score portion should not be limited to a depressed line. Also, the bead portions are not necessarily to be formed on both sides of the fold guide, and it may be sufficient to form the bead portion only on one side of the fold guide. Otherwise, the bead portion is not necessarily to be provided. The overlapping. portion whose section is S-shape and formed on the edge of the opening piece may also be provided according to need.

Figure 5:
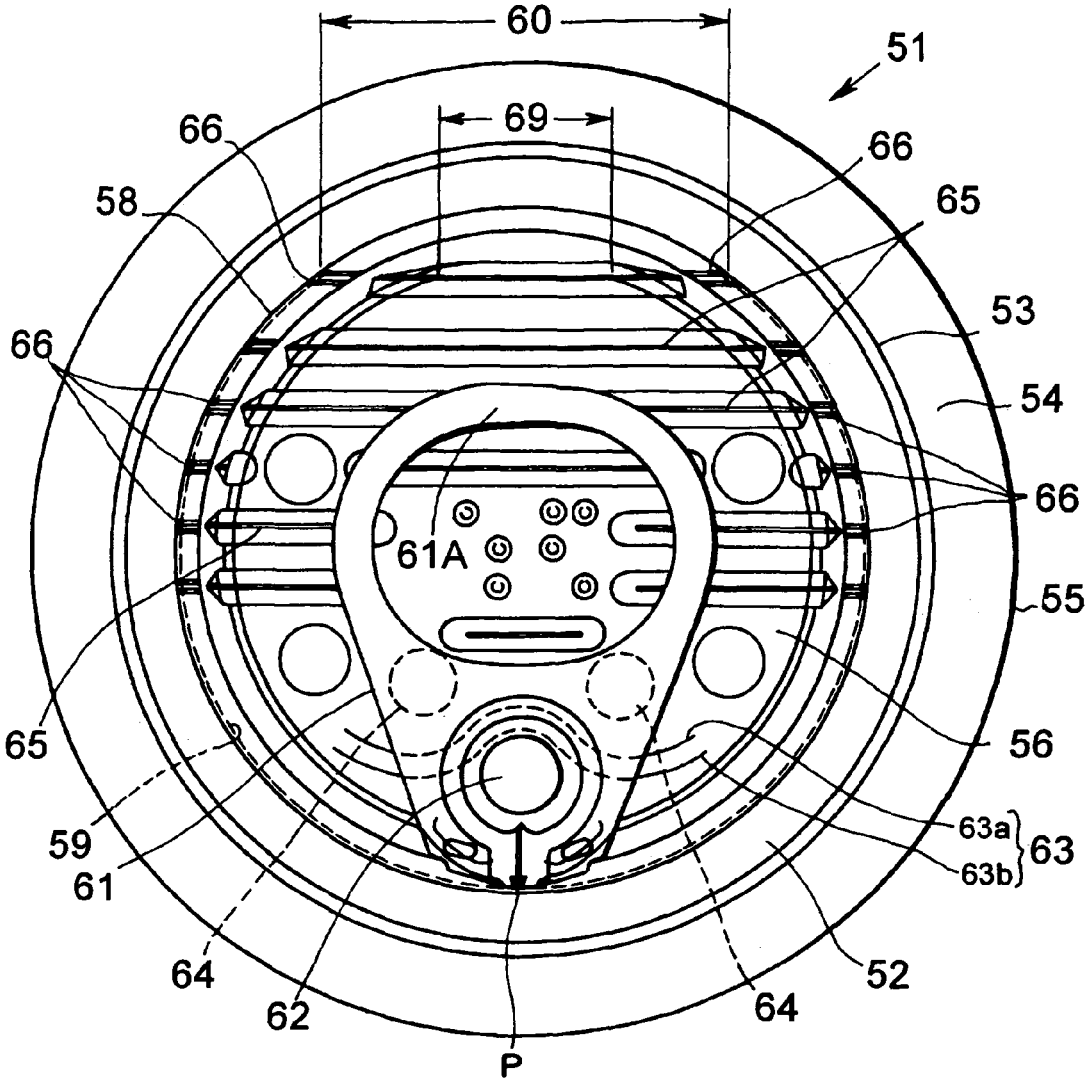
FIG. 5 is a front view showing another example of the can lid of the invention.
Figure 6:
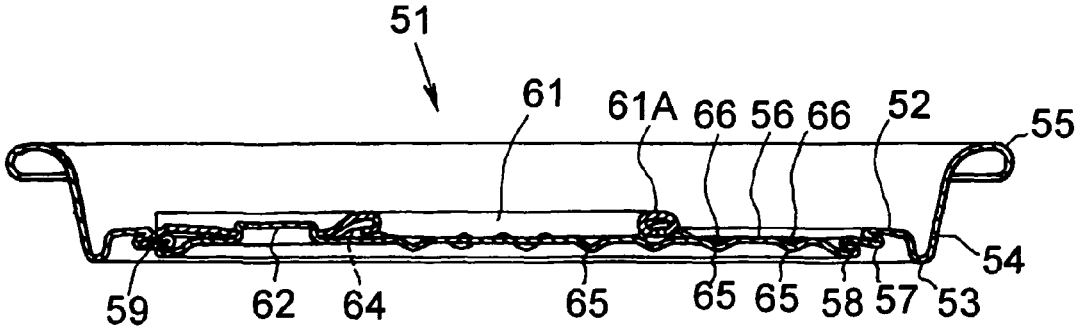
FIG. 6 is a sectional side view of the can lid illustrated in FIG. 5.

Next, here will be explained another embodiment of the can lid according to the present invention. A can lid 51 of the present invention having a score line is illustrated in FIGS. 5 and 6. The can lid 51 is manufactured from a metal sheet by a press forming. Metal sheets of aluminum alloy defined by Japanese Industrial Standards (JIS), e.g., 3003 series, 3004 series, 5052 series and 5182 series, a surface-treated steel sheet of tin-free steel or the like, a tin-plated steel sheet, a chrome-plated steel sheet, an aluminum-coated steel sheet, a nickel-plated steel sheet, and other various kinds of alloy plated steel sheets can be used as a material of the can lid 51. The can lid 51 shown in FIGS. 5 and 6 is shaped entirely into a circle, and an annular groove 53 is formed on the outer circumferential side of a substantially flat panel portion 52 positioned in the central part of the can lid 51. A side wall of the outer circumferential side of the annular groove 53 erecting higher than an upper face of the panel portion 52 is a chuck wall 54. An upper end portion of the chuck wall 54 is bent outwardly to form a flange portion 55. As in the known can lids of the conventional prior art, those chuck wall 54 and the flange portion 55 are used to seam a (not shown) can trunk. For this purpose, an (not shown) organic polymer sealing agent is applied to an inner face of the flange portion 55.

An opening piece 56 overlies most part of the panel portion 52, within a predetermined radius centered at central portion of the panel portion 52. Specifically, an outer overlapping portion 57 is formed in the panel portion 52 and inside of the annular groove 53, by folding a metal sheet into a multiple layers. The outer overlapping portion 57 has a three-layer structure, which is formed by folding a portion of the panel portion 52 downwardly and outwardly, and then folding downwardly and inwardly.

Also, there is formed an inner overlapping portion 58 extending from the outer overlapping portion 57. The inner overlapping portion 58 also has a three-layer structure, which is formed by folding a portion of the metal sheet extending from the outer overlapping portion 57 toward the center side of the panel portion 52 downwardly and outwardly, and then folding downwardly and inwardly.

Figure 7:
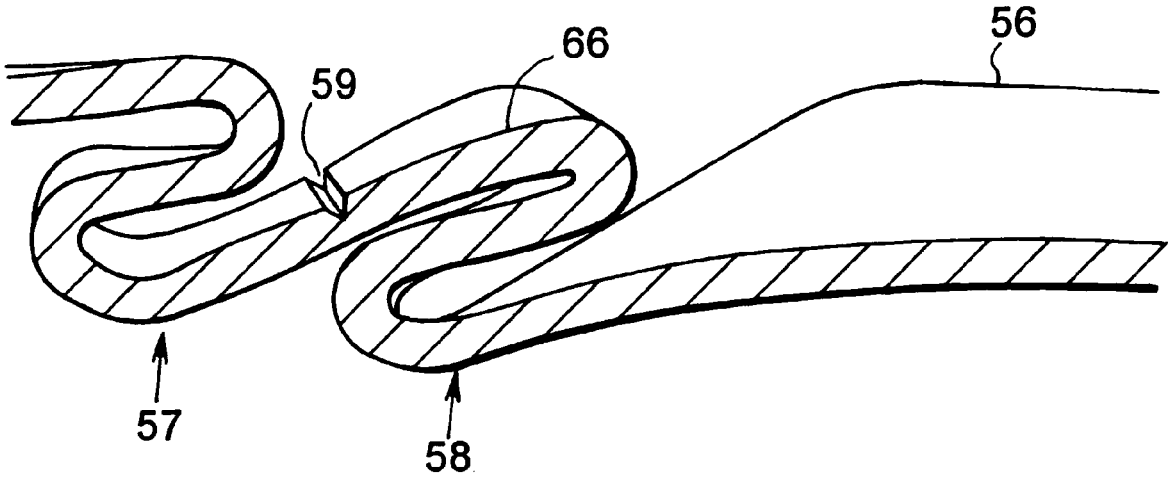
FIG. 7 is an enlarged partial sectional view showing the overlapping portion.

A score line 59 is formed between those inner and outer overlapping portions 57 and 58. As illustrated in FIG. 7, the score line 59 is a groove formed on an upper face of the metal sheet of the panel portion 52. The residual thickness of the score line 59 is thinner than that of the remaining portion so that the score line 59 is ruptured easier in comparison with the remaining portion when a load is applied. That is, the opening piece 56 is the portion defined by the score line 59.

The score line 59 can be formed into a complete circle, however, according to the illustrated embodiment, the score line 59 is formed into arcuate along the periphery of the panel portion 52 and both end portions thereof are separated. That is, a portion where the score line 59 is not formed is a connecting portion 60 for connecting the opening piece 56 with. the panel portion 52. Accordingly, the metal sheet is not the ruptured at the connecting portion 60.

An opening tab 61 is provided on the outer circumference of the opening piece 56 in the opposite side of the connecting portion 60 across the central portion. The tab 61 initiate a rupture of the score line 59 by a principle of leverage, and the rupture of the score line 59 is propagated by a shearing force established as the tab 61 is lifted. The tab 61 is fixed onto the opening piece 56 by a rivet 62 formed by projecting a portion of the opening piece 56 upwardly. Under the condition where the tab 61 is thus fixed, a leading end portion of the tab 61 is positioned very close to (i.e., right in front of) the score line 59 on the upper face of the opening piece 56. On the other hand, a ring shaped finger grip portion 61A is formed on the rear end portion of the tab 61.

In the vicinity of the rivet 62 of the opening piece 56, there is formed a bend score portion 63, which comprises a main score line 63*a* which is to be ruptured, and a sub score line 63*b* which is not to be ruptured. This bend score portion 63 is provided to facilitate a deformation of the opening piece 56 when the load is applied to open the can lid so as to help an operation of the tab 61. Also, a pair of convex portions 64 and 64 is formed underneath the tab 61 by projecting the metal sheet forming the opening piece 56 upwardly. Those convex portions 64 are provided to prevent a swiveling of the tab 61 by engaging with a lower face of the tab 61.

Figure 8:
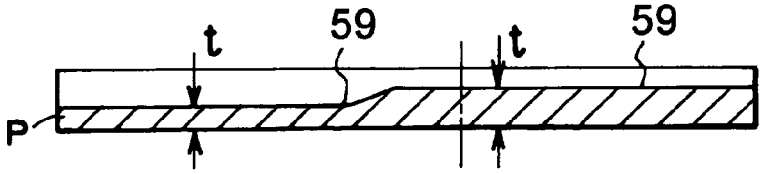
FIG. 8 is a schematic diagram showing an example of the strength incrementing portion of the score line.

The rupture of the score line 59 propagates from the initial ruptured point initiated by depressing the leading end portion of the tab 61 toward the end portion of the connecting portion 60. However, in order to avoid an abrupt open of the can lid, the score line 59 is configured to have a harder structure to be ruptured in its the end portion side. An example of such configuration is illustrated in FIG. 8. FIG. 8 is a development sectional view showing a residual thickness "t" within a half range of the arcuate score line 59, from the initial ruptured point represented by "P" in FIG. 5 to the end portion. Specifically, such range is approximately 144 degrees with reference to the center point of the opening piece 56. In FIG. 8, the initial ruptured point P is presented in the left end, and the right side is the end portion of the score line 59 on the connecting portion 60 side. In the embodiment shown in this figure, the residual thickness "t" is relatively thinner within the range from the initial ruptured point P to a point of approximately 65 degrees, and an uneven portion is formed within the range from a point of approximately 65 degrees to a point of approximately 70 degrees. In this uneven portion, the residual thickness is getting thicker and its height difference is approximately 60 μm. In the range from the point of approximately 70 degrees to the end portion of the connecting portion 60 side, the residual thickness "t" of the score line 59 is even. According to the constitution shown in FIG. 8, therefore, the shear dimension is large in the range further than the point of 65 degrees counted from the initial ruptured point P This means that the score line 59 is hard to be ruptured in the aforementioned range. The portion in which the residual thickness "t" is thus thicker than the remaining portion corresponds to a strength incrementing portion of the invention.

In the opening piece 56, there is formed a bead portion 65 for enhancing the stiffness against deformation due to expansion. The bead portion 65 is formed by depressing a portion of the opening piece 56 linearly, and its sectional shape is V-shape. In the embodiment illustrated in FIGS. 5 and 6, a plurality of bead portions 56 are formed in the direction perpendicular to the direction to pull the tab 61, i.e., to the line joining the leading end portion of the tab 61 and the center portion of the connecting portion 60. In other words, those bead portions 56 are formed in the direction perpendicular to the line joining the initial ruptured point P and the center portion of the panel portion 52, or to the direction to pull the tab 61 from the peripheral portion of the panel portion 52 where the tab 61 is fixed to the opposite side of the peripheral portion of the panel portion 52 across the central portion of the panel portion 52. At least one of the end portions of the bead portion 56 extends close to the peripheral portion of the opening piece 56.

A height of the bead portion 65 and a curvature radius of its bottom portion (i.e., a leading end) is preferably within a range of 0.2 mm to 1.0 mm, and a clearance between the bead portions 65 is preferably within a range of 3 mm to 6 mm, more preferably, 4 mm to 5.5 mm. If the clearance between the bead portions 65 is smaller than 3 mm, the bead portion 65 cannot be bent smoothly by a principle of leverage. On the other hand, if the clearance between the bead portions 65 is larger than 6 mm, the score line 59 may be ruptured at once when the can lid is opened so that the contents may be scattered out of the can.

The aforementioned bead portion 65 counteracts to suppress a deformation of the opening piece 56 to be deformed into a domed shape. However, in contrast, the bead portion 65 does not exhibit its specific strength against a folding along a valley line aside of the bead portion 65. In fact, the bead portion 65 functions to facilitate such a valley folding. In order to facilitate a folding also at the inner overlapping portion 58 formed on the opening piece 56, a weakened portion 66 is formed on an upper face of the inner overlapping portion 58 as an extension of the bead portion 65. The weakened portion 66 is formed by depressing a portion of the upper face of the inner overlapping portion 58, and a sectional shape thereof is V-shape. A depth of the depression and a curvature radius of a bottom of the V-shaped groove are preferably within a range of 0.1 mm to a thickness "T" (e.g., approximately 0.23 mm). This weakened portion 66 functions to facilitate a valley fold of the inner overlapping portion 58 in its longitudinal direction.

Figure 9:
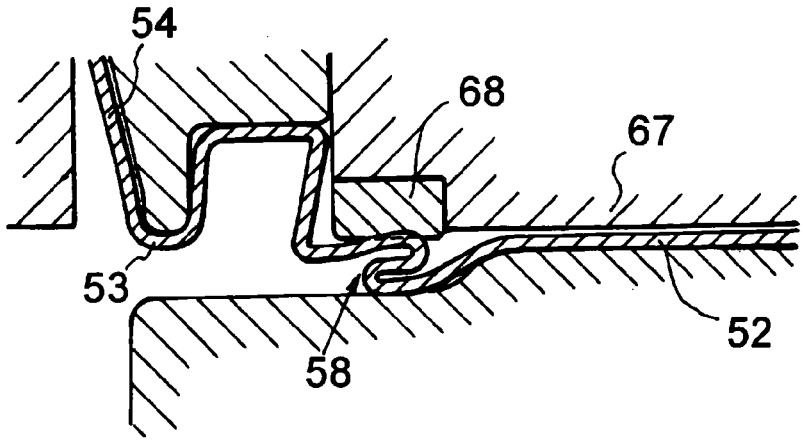
FIG. 9 is a schematic diagram showing one example of an apparatus forming the weakened portion.

FIG. 9, illustrates one example of an apparatus for forming the aforementioned weakened portion 66. A plurality of forming blades 68 are mounted on an outer circumference of a punch 67 which are used at a caulking step of the tab 61. A shape of a leading end portion of the forming blade 68 is congruent with that of the weakened portion 66. At the caulking step of the tab 61 using the punch 67, the inner overlapping portion has already been formed. Therefore, the forming blade 68 mounted on the outer circumference of the punch 67 depresses a portion of an upper face of the inner overlapping portion 58 when the punch 67 descends to caulk the tab 61, and the aforementioned weakened portion 66 is thereby formed.

Figure 10A:
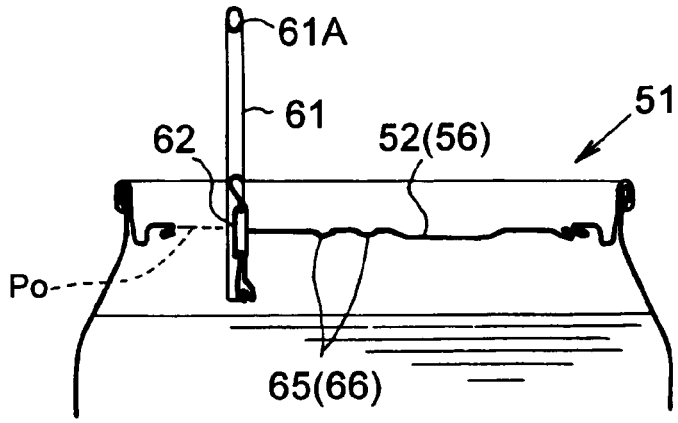
FIG. 10A is an explanatory sectional view showing an initial phase of opening the can lid of another example.
Figure 10B:
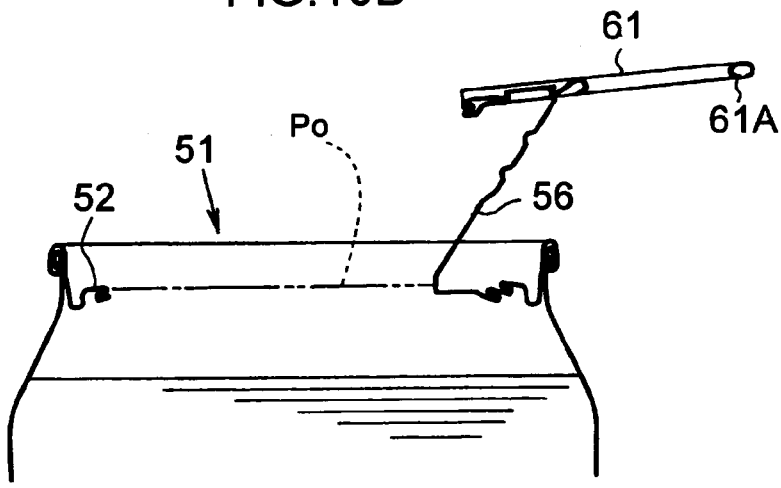
FIG. 10B is an explanatory sectional view showing an intermediate phase of opening the can lid of another example.
Figure 10C:
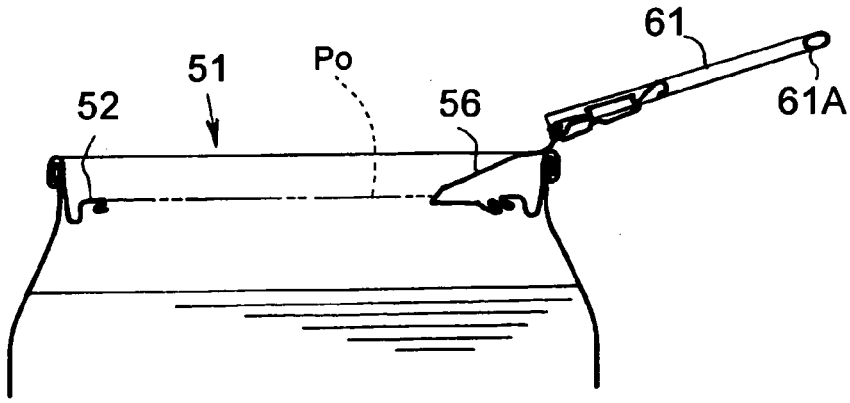
FIG. 10C is an explanatory sectional view showing a final phase of opening the can lid of another example.
Figure 11:
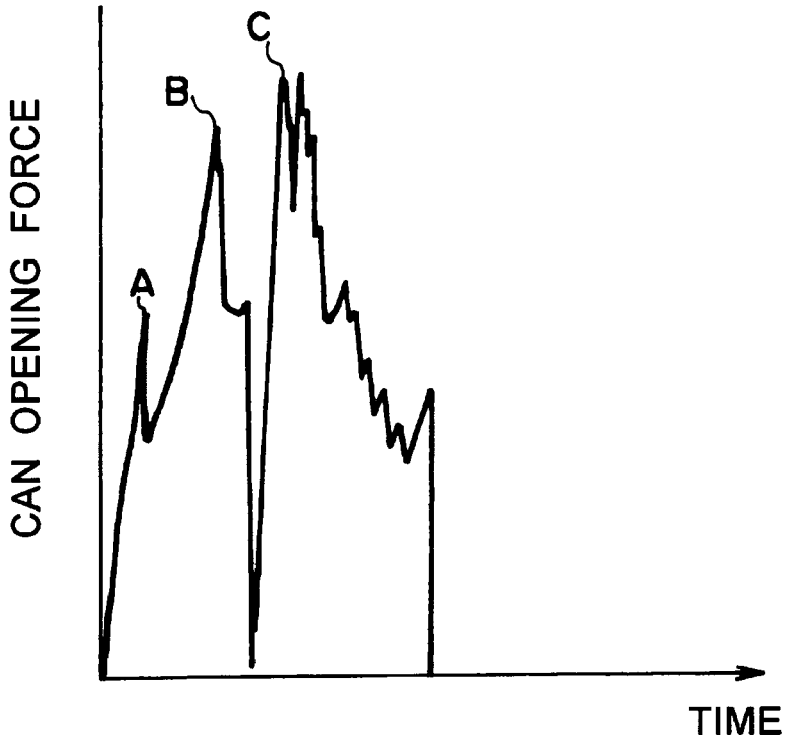
FIG. 11 is a line plot showing a change of a lid opening force in the can lid of the invention.

A procedure of an opening operation of the aforementioned can lid 51 will be explained hereinafter. FIGS. 10A, 10B and 10C are sectional views schematically showing a displacement of the opening piece 56, and FIG. 11 is a line plot showing a change in a force applied to the tab 61, during the opening operation of the can lid. At first, the finger grip portion 61A formed on the rear end portion of the tab 61 is lifted so that the leading end portion of the tab 61 presses the upper face of the opening piece 56. As a result of this, the bend score portion 63 is lifted by a reaction force acting through the rivet 62 as a fulcrum. The force applied to the tab 61 is increased gradually and the aforementioned main score line 63*a* is ruptured during such process. The state just before an initiation of rupture is called a "bend-pop", and the force applied on this occasion is represented by "A" in FIG. 11.

When the finger grip portion 61A of the tab 61 is further lifted, a portion in the vicinity of the leading end portion of the tab 61, i.e., a portion of the score line 59 opposite to the connecting portion 60 side, is pressed downwardly by a principle of leverage in which the rivet 62 functions as a fulcrum and the leading end portion of the tab 61 functions as a point of application. As a result of this, a rupture the score line 59 is initiated. The state just before the initiation of rupture is called a "score-pop", and the force applied on this occasion is represented by "B" in FIG. 11. In FIG. 10A, there is illustrated a state where the finger grip portion 61A is further lifted from the state called the "score-pop".

Then, the tab 61 is pulled entirely in the upward direction or in the direction toward the connecting portion 60, so that the rupture is propagated along the score line 59 toward the connecting portion 60. At that time, a stress is produced in conjunction with starting of a shearing so that the force applied to the tab 61 becomes larger. This state is called a "tear", and the force applied on this occasion is represented by "C" in FIG. 11.

Subsequently, the rupture propagates along the score line 59 and the force applied to the tab 61 becomes smaller. However, when the rupture reaches the aforementioned weakened portion 66, the rupture is once halted in connection with a folding of the opening piece 56. Then, the rupture is moved forward again by a forthcoming augmentation of the force applied to the tab 61. Thus, the opening operation of the can lid proceeds while repeating the rupture of the score line 59 and the folding of the weakened portion 66. Therefore, as shown in FIG. 11, the required force to open the can lid undulates while increasing and decreasing, and decreases eventually. FIG. 11 indicates the data on a can lid which does not comprise the aforementioned strength incrementing portion so that the applied force does not increase. In contrast, if the can lid is provided with the strength incrementing portion, the force applied to the tab 61 undulates while increasing and decreasing, and slightly increases at the final phase in accordance with the strength incrementing portion.

FIG. 10B shows a state where the rupture reaches the end portion of the score line 59 at which the rupture of the score line 59 halts. In this state, the operation to pull the tab 61 is halted so that the force applied to the tab 61 increases temporarily. However, as explained above, the opening force of the can lid is weakened in front of the connecting portion 66 as a result of the repetition between the folding of the weakened portion 66 and rupturing of the score line 59. Therefore, the rupture of the score line 59 does not extend to the connecting portion 66 so that the opening piece 56 is kept connected with the can lid.

In case the strength incrementing portion is formed by thickening the residual thickness "t", or by widening the width "W" of the score line 59, momentum of the propagation of the rupture is also weakened in the portion close to the end portion of the score line 59. Therefore, the propagation of the rupture can be halted at the end portion of the score line 59. For this reason, the connecting portion 60 can be certainly prevented from being ruptured, so that the opening portion 56 can be kept connected with the can lid.

As illustrated in FIG. 10C, the opening piece 56 thus opened is pushed down in order not to interrupt the ejection of the contents.

Figure 12:
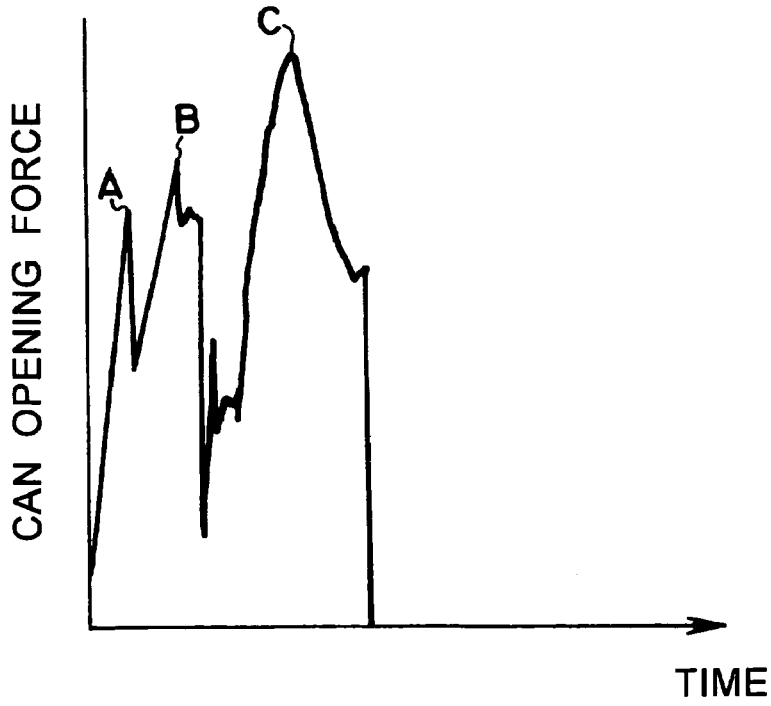
FIG. 12 is a line plot showing a change of a lid opening force in a can lid as a comparative example in which the weakened portion and the bead portion are not provided.

FIG. 12 shows a change in a required force to open a can lid without comprising the aforementioned weakened portion 66 and bead portion 65. As those in FIG. 11, points "A", "B" and "C" in FIG. 12 individually represent the forces at the states of the "bend-pop", the "score-pop" and the "tear". In case the weakened portion 66 and bead portion 65 are not provided, the applied force increases just before the completion of the opening operation of the can lid. Therefore, the rupture may extends to the connecting portion 60 so that the opening piece 56 may be detached from the can lid. Moreover, the contents may be scattered by an impact resulting from an abrupt opening of the can lid.

According to the present invention, as illustrated in FIG. 5, it is possible to form a fold guide 69 such as a depressed line similar to the score line connecting the both end portions of the score line 59 of the opening piece 56. A bending strength of the fold guide 69 is smaller than that of a remaining flat portion of the opening piece 56, so that the fold guide 69 can be folded easier than the flat portion. In the embodiment illustrated in FIG. 5, the fold guide 69 is formed in the furthermost bead portion 65 from the aforementioned initial ruptured point. That is, the weakened portion 66 is formed as an extension of the fold guide 69. With this construction, the force applied to the tab 61 acts to fold the opening piece 56 at the final phase of the opening operation or the propagation of the rupture. As a result, the connecting portion 60 can be prevented from being ruptured.

An essential condition of the strength incrementing portion of the invention is that a shear strength thereof along the score line 59 is higher than that of the portion in the vicinity of the initial ruptured point represented by "P" in FIG. 5. Therefore, a shape of the strength incrementing portion should not be limited to the shape illustrated in FIG. 8. For example, the strength incrementing portion may be formed into the shapes illustrated in FIGS. 13A and 13B.

Figure 13A:
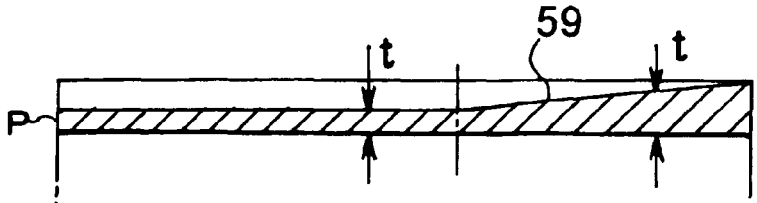
FIG. 13A is a schematic diagram showing another example of the strength incrementing portion in which the residual thickness of the score line is increased gradually.

More specifically, FIG. 13A is a development sectional view showing a residual thickness "t" in a half range of the score line 59. In FIG. 13A, the initial ruptured point P is presented in the left side, and the end portion of the connecting portion 60 side is presented in the right side. As illustrated in FIG. 13A, the residual thickness "t" is thinner within a range of 90 degrees from the initial ruptured point P, and the residual thickness "t" gets gradually thicker, in other wards, the depth of the score line 59 gets gradually shallower, in the remaining range to the end portion of the connecting portion 60 side. Therefore, the dimension to be ruptured by shearing is large in the strength incrementing portion, so that the score line 59 is hard to be ruptured in the strength incrementing portion.

Figure 13B:
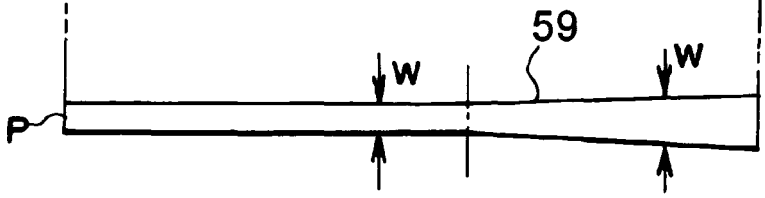
FIG. 13B is a schematic diagram showing another example of the strength incrementing portion in which the width of the score line is widened gradually.

FIG. 13B is also a development sectional view showing a change in the width "W" in a half range of the score line 59. In FIG. 13B, the initial ruptured point P is presented in the left side, and the end portion of the connecting portion 60 side is presented in the right side. As illustrated in FIG. 13B, the width W of the score line 59 is relatively narrower within a range of 90 degrees from the initial ruptured point P, and the width W gets gradually wider in the remaining range to the end portion of the connecting portion 60 side. Therefore, the stress is hard to be concentrated at the bottom of the score line 59 in the portion close to the end portion of the connecting portion 60 side, so that the score line 59 is hard to be ruptured in this widened portion.

The present invention can be applied to a can lid, in which a portion to be an opening piece overlies no less than 50 percent and no more than 99 percent of the panel portion. The present invention can also be applied to a can lid, in which a score line is formed around the panel portion within a range of approximately 180 degree with respect to the center of the panel portion, and an opening piece opens halfway across the panel portion. Moreover, the present invention can be applied to the aforementioned can lid comprising a full-open type score line which is drawn circularly. Additionally, the overlapping portion of the invention is not necessarily formed on both inner and outer circumferential sides of the score line. The present invention can also be applied to a can lid in which the overlapping portion is formed on any one of inner and outer circumferential sides of the score line.

The present invention can also be applied to a full-open type easy open can lid in which an opening piece is to be detached completely. In this case, the strength incrementing portion for enhancing the resistance of the score line against the rupture may be formed in an intermediate portion between an initial ruptured point and a portion on an opposite side across the center of the can lid, in a predetermined length. An example is lustrated in FIG. 14.

Figure 14:
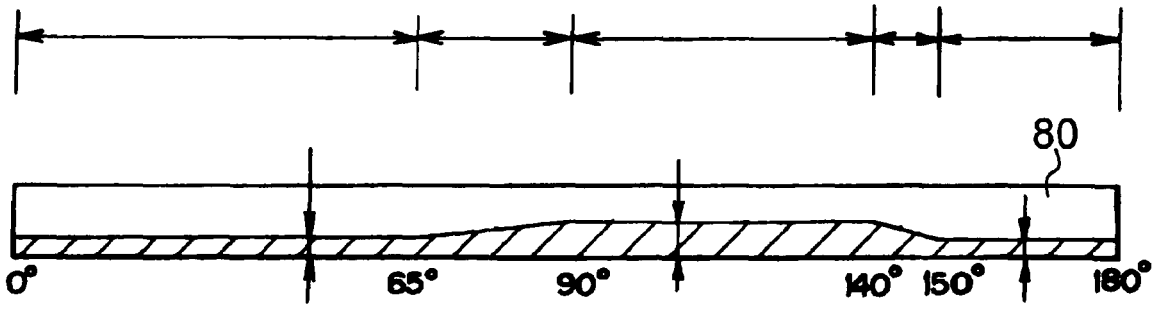
FIG. 14 is a schematic diagram showing a yet another example of the strength incrementing portion in the score line.

FIG. 14 shows a section of a score line 80 formed entirely into a circular shape, within a range from an initial ruptured point P (i.e., a position of zero degree) to a point of 180 degrees. For example, a residual thickness t1 is relatively thinner within a range from the initial ruptured point P to the point of approximately 65 degrees, and the residual thickness gets gradually thicker to the point of approximately 90 degrees. In the range from the point of approximately 90 degrees to the point of 140 degrees, a residual thickness t2 is relatively thicker. The residual thickness gets gradually thinner from the point of approximately 140 degrees to the point of 150 degrees, and the residual thickness in the range from the point of approximately 150 degrees to the point of 180 degrees is the residual thickness t1 which is comparable with the one in the initial ruptured point P side.

Figure 15:
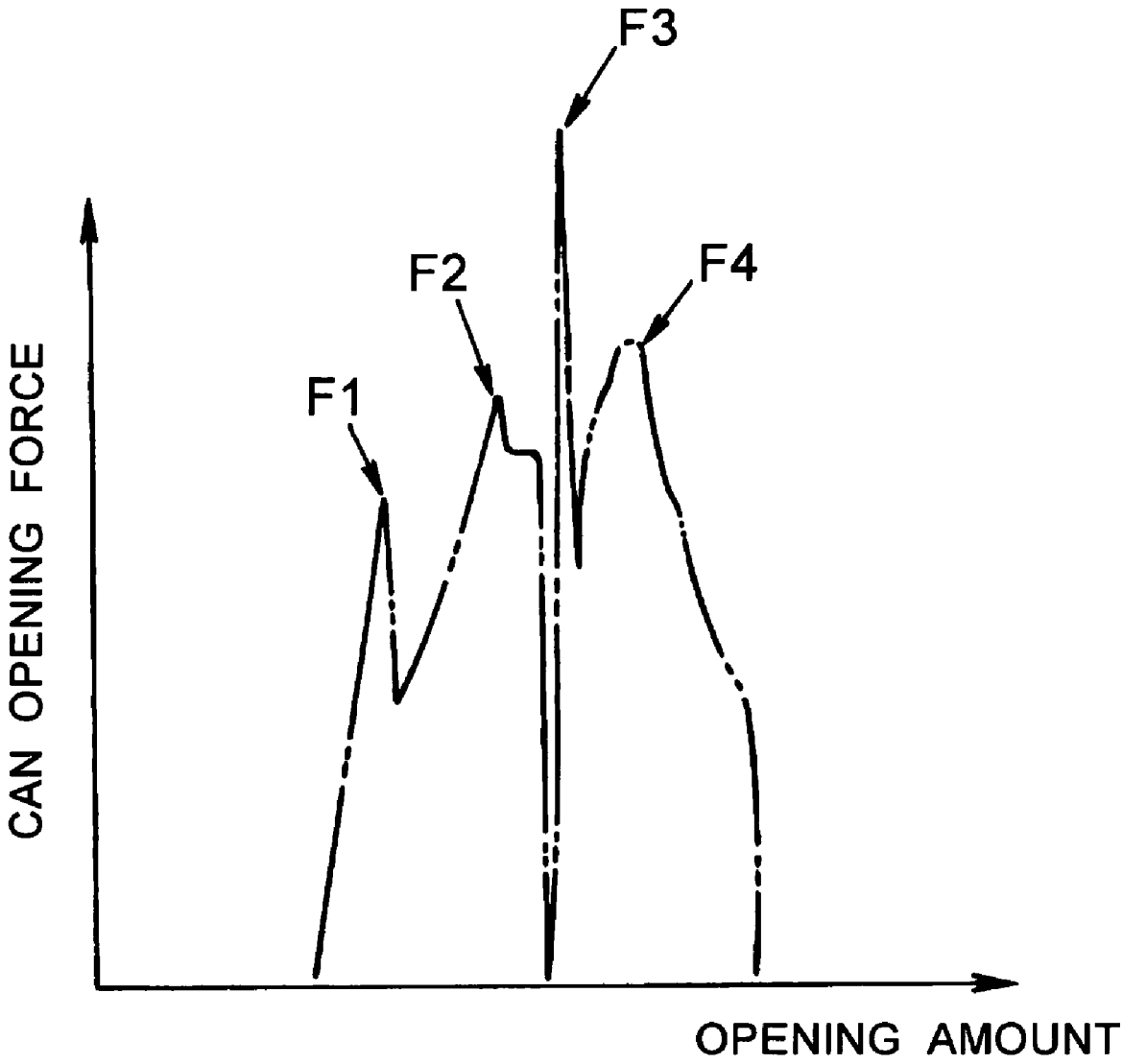
FIG. 15 is a line plot showing a change of a lid opening force in the score line illustrated in FIG. 14.

FIG. 15 shows a change in a lid opening force of the case in which the score line 80 is thus formed as described above. A rupture is initiated in an auxiliary score line by lifting a rear end portion of a tab, and a local maximum value of this operation is represented by a point F1 in FIG. 15. That is, this is the state called the "bend-pop". Then, the opening force exhibits a local maximum value again at the instance when the rupture of the score line 80 is initiated. This is the state called the "score-pop" and it is represented by a point F2 in FIG. 15.

The rupture is propagated along the score line 80 when the tab is further lifted. However, the opening force becomes maximum at a starting instance of shearing. This is indicated in FIG. 15 by a point F3. That is, this is the state called the "tear". When the shearing is started, the can lid opening force required for shearing becomes relatively smaller. Then, the shearing stress increases when the shearing reaches the strength incrementing portion whose residual thickness is thicker than the remaining portion, so that the can lid opening force increases again. This is indicated in FIG. 15 by a point F4. The residual thickness becomes thinner again after the strength incrementing portion is completely sheared. Therefore, the can lid opening force decreases again and the can lid is completely opened eventually.

Accordingly, in case of forming the score line 80 as illustrated in FIG. 14, the shearing is halted or suppressed temporarily at the strength incrementing portion where the residual thickness is thick. For this reason, the opening piece is prevented from being detached abruptly, and the contents are prevented from being scattered out of the can.

Furthermore, the present invention can also be applied to a half-open type easy open can lid, in which a half area of a circle centered at a center point of a panel portion is an opening piece. In this case, a score line is drawn as a semicircle whose center angle is 180 degree. That is, a line connecting both ends of the score line intersects the center point of the panel portion. A fold guide connecting the both ends of the score line also intersects the center point of the panel portion.

What is claimed is:

1. An easy open can lid, comprising:

an approximately disc-shaped panel portion integral with a flange portion fixing a can trunk formed on an outer circumference of the panel portion;

a score line as a groove, the groove having a section which is substantially V-shaped, the score line formed near and along the outer circumference of the panel portion, the score line formed of an arcuate around a periphery of the panel portion, and both ends of the score line being separated;

an opening piece defined by the score line which is no less than 50 percent and no more than 99 percent of the panel portion;

an opening tab fixed near the periphery of the opening piece;

a connecting portion, which is formed between the both ends of the score line, for connecting the opening piece with a periphery of the panel portion;

a strength incrementing portion of the score line, which increases a rupture resistance gradually toward the both ends of the score line by increasing both of a thickness of the metal sheet underneath the panel portion and a width of the score line gradually toward the both ends of the score line within a predetermined range near the connecting portion;

an annular rim, as an outer circumference of the panel portion, formed integral with the flange portion; and a folded portion forming three layers, which is formed on at least one of an inner end of the annular rim and an outer end of the panel portion by folding the inner end of the annular rim or the outer end of the panel portion into three layers, the score line being formed on the folded portion such that the score line ruptures in response to a force applied to the folded portion.

2. The easy open can lid according to claim 1, further comprising:

a fold guide guiding a folding of the opening piece at the connecting portion, which is formed in the vicinity of the connecting portion.

3. The easy open can lid according to claim 2, wherein the fold guide includes a bead portion, which is formed in the vicinity of a line connecting both ends of the score line.

4. The easy open can lid according to claim 2, wherein the fold guide includes a depressed line, which is formed in the vicinity of a line connecting both ends of the score line.

5. The easy open can lid according to claim 1, wherein the folded portion is formed by folding a portion of a metal sheet into multiple layers along the score line of the panel portion.

6. The easy open can lid according to claim 5, wherein the folded portion is formed entirely around an outer circumference of the opening piece defined by the score line, and entirely around an inner circumference of an opening created as a result of a rupture of the score line.

* * * * *